US007231883B1

(12) United States Patent
Cooper et al.

(10) Patent No.: US 7,231,883 B1
(45) Date of Patent: Jun. 19, 2007

(54) APPARATUS INCLUDING VEHICLE, CONSOLE AND MOLDED CANOPY

(75) Inventors: William Daniel Cooper, Troutman, NC (US); Luther Thomas Smith, Pelion, SC (US); Edward Ernest Forbes, Columbia, SC (US)

(73) Assignee: Marine Polymer Design, LLC, Troutman, NC (US)

( * ) Notice: Subject to any disclaimer, the term of this patent is extended or adjusted under 35 U.S.C. 154(b) by 0 days.

(21) Appl. No.: 11/238,835

(22) Filed: Sep. 29, 2005

(51) Int. Cl.
*B63B 17/00* (2006.01)

(52) U.S. Cl. ..... 114/361; 296/102

(58) Field of Classification Search ..... 114/343, 114/361; 296/102, 103, 104, 105, 211
See application file for complete search history.

(56) References Cited

U.S. PATENT DOCUMENTS

| | | | | |
|---|---|---|---|---|
| 5,094,500 | A * | 3/1992 | Maypole et al. | 296/102 |
| 5,662,063 | A * | 9/1997 | Seijas | 114/361 |
| 6,309,012 | B1 * | 10/2001 | Fryk et al. | 296/211 |
| 6,691,637 | B1 | 2/2004 | Smith | 114/361 |
| 6,725,799 | B2 * | 4/2004 | Tull | 114/361 |

* cited by examiner

*Primary Examiner*—Lars A. Olson
(74) *Attorney, Agent, or Firm*—MacCord Mason PLLC

(57) ABSTRACT

An apparatus including: a vehicle; a console attached to the vehicle; and an integrally formed, internally supported, molded canopy attached to the vehicle. In various embodiments, the apparatus further includes a frame attached to the vehicle for supporting the canopy and the canopy may include an internal electrical system.

21 Claims, 4 Drawing Sheets

APPARATUS INCLUDING VEHICLE, CONSOLE AND MOLDED CANOPY

BACKGROUND (1) Field of the Disclosure

The disclosure relates generally to an apparatus including a vehicle, a console attached to the vehicle, and a molded canopy. More particularly, the molded canopy is integrally formed and internally supported, and may include an internal electrical system.

(2) Description of the Field

Sport fishing boats are often outfitted with permanent canopies. The canopies can be made of various materials such as canvas or fiberglass depending on the functional and styling preferences of boaters. Fiberglass canopies have traditionally been more desirable, owing to such factors as durability, ease of maintenance, and attractive styling. The fiberglass tops, however, require a costly manufacturing process and are thus usually more expensive than canvas canopies.

Thus, there is a need for an apparatus including a vehicle, a console attached to the vehicle, and an integrally formed, internally supported, molded canopy. Furthermore, there is a need for an integrally formed, internally supported, molded canopy including an internal electrical system.

SUMMARY

The disclosure describes embodiments of an apparatus including: a vehicle; a console attached to the vehicle; and an integrally formed, internally supported, molded canopy attached to the vehicle. In various embodiments, the apparatus further includes a frame for supporting the canopy above the console and the canopy may include an internal electrical system. The disclosure also describes a blind fastener system for attaching a canopy to a support frame. The blind fastener system may include an insert, a fastener, and a mounting pad.

The canopy may include an outer skin in turn including a top layer and a bottom layer, and a foam support layer may be employed between the top and bottom layers of the outer skin. The foam support layer may or may not fill a space between the top and bottom layers of the outer skin.

The canopy may also include a plurality of supports molded through or within the outer skin and at least partially surrounded by the foam support layer for suspending equipment within the foam support layer. The plurality of supports may include a molded-in insert. In addition, one or more of the supports may have a passage for suspending equipment within the foam support layer. Further, the equipment suspended in the foam support layer of the canopy may include electrical equipment, which may in turn include one or more of a wire and a wire chase.

In addition, the canopy may also include an integrally formed, double-walled electronics box, such that a box insert and fastener for retaining the insert is not necessary. The bottom layer of the outer skin may form an inner wall of the box with an additional outer wall below. Also, a foam support layer may be employed between the walls of the box.

Furthermore, the vehicle can be a marine vessel having a motor, which may in turn have a propeller, and the frame may include an elevation member and a mounting pad. The mounting pad may include an opening for inserting the fastener.

Further, in embodiments of the blind fastener system, the inserts may include one or more of a wedge or cone-shaped portion, a portion having substantially parallel walls, and a lip for supporting the insert in the canopy. Furthermore, in embodiments, the blind fastener system is not visible from below the canopy.

The disclosure also describes an apparatus including: a vehicle; a console attached to the vehicle; and an integrally formed, internally supported, molded canopy attached to the vehicle.

Furthermore, the disclosure describes a molded canopy that is integrally formed and internally supported, and includes an internal electrical system.

The disclosure also provides an apparatus including: a vehicle; a console attached to the vehicle; an integrally formed, internally supported, molded canopy including an internal electrical system therein; and a frame attached to the vehicle for supporting the canopy.

These and other embodiments disclosed will become apparent to those skilled in the art after a reading of the following description of the various embodiments when considered with the drawings.

DESCRIPTION OF VARIOUS EMBODIMENTS

Figure 1:
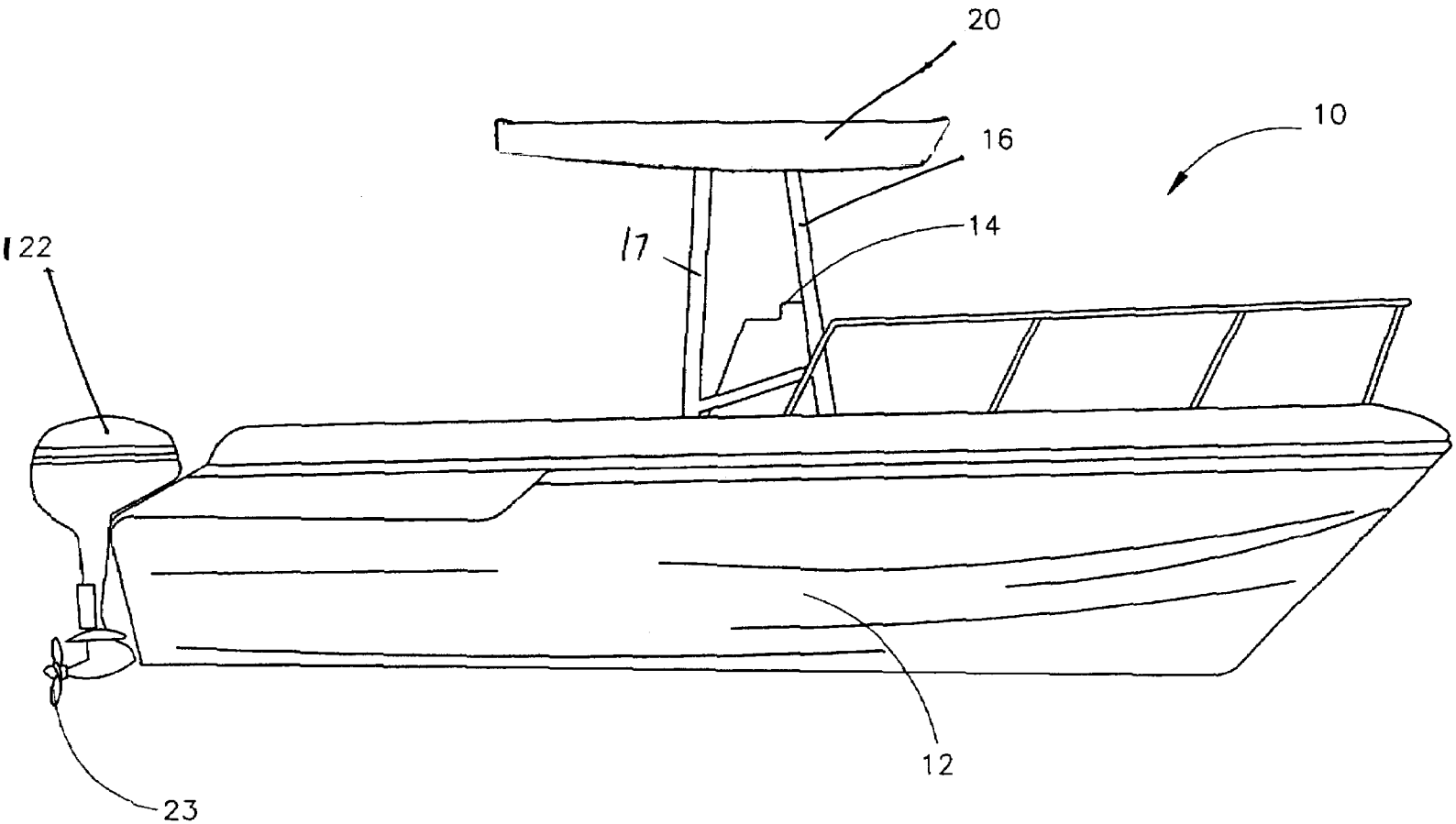
FIG. 1 is a side view of an embodiment of a vehicle, a console, and a molded canopy.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations and descriptions are for the purpose of describing various embodiments and are not intended to limit the appended claims. FIG. 1 shows an embodiment of an apparatus 10 including a vehicle 12, a console 14 attached to the vehicle 12, and an integrally formed, internally supported, molded canopy 20. A frame 16 including an elevation member 17 and may support the canopy 20 above the console 14 of the vehicle 12. The vehicle 12 may include a motor 122 and, in the embodiments shown in FIG. 1, is a marine vessel. In these embodiments, the motor 122 includes a propeller 23.

Figure 2:
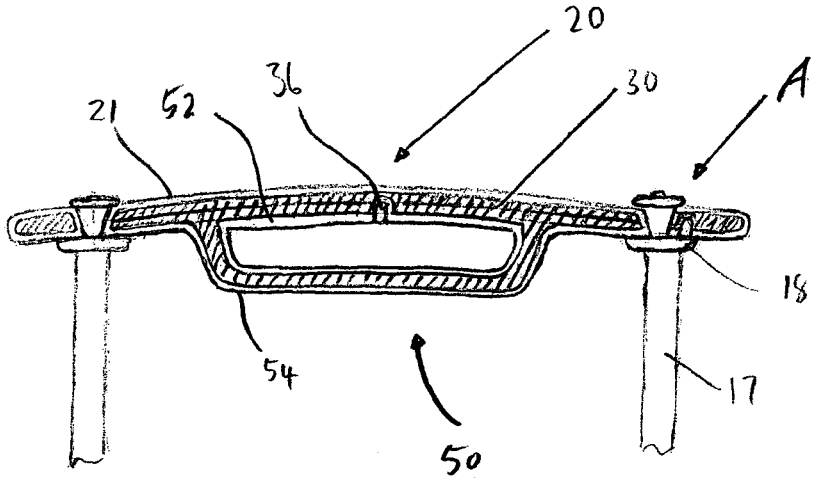
FIG. 2 is a rear cross-section view of the molded canopy.

FIG. 2 is a rear cross section of an embodiment of an integrally formed, internally supported, molded canopy 20 including an internal electrical system 30 attached to a mounting pad 18 atop an elevation member 17 of a frame and an integrally formed electronics box 50.

Figure 3:
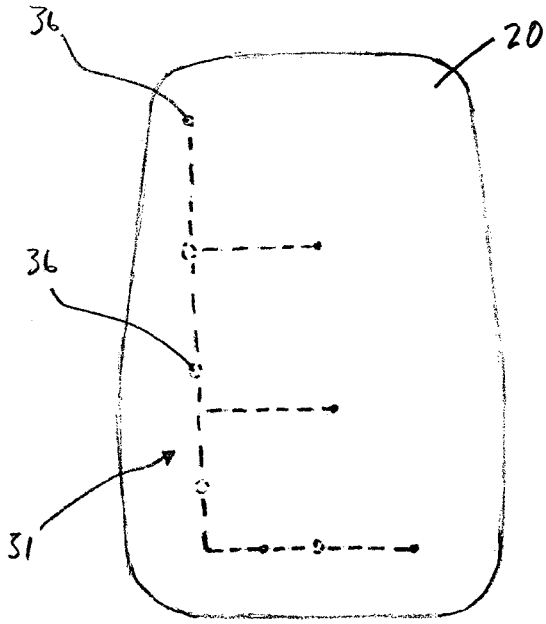
FIG. 3 is a top view of a molded canopy showing an internal electrical system.

FIG. 3 is a top view of the molded canopy 20 showing an internal electrical system 30 in hidden view, including a plurality of supports 36 for suspending equipment 31, which may include electrical equipment, within the canopy 20.

Figure 4:
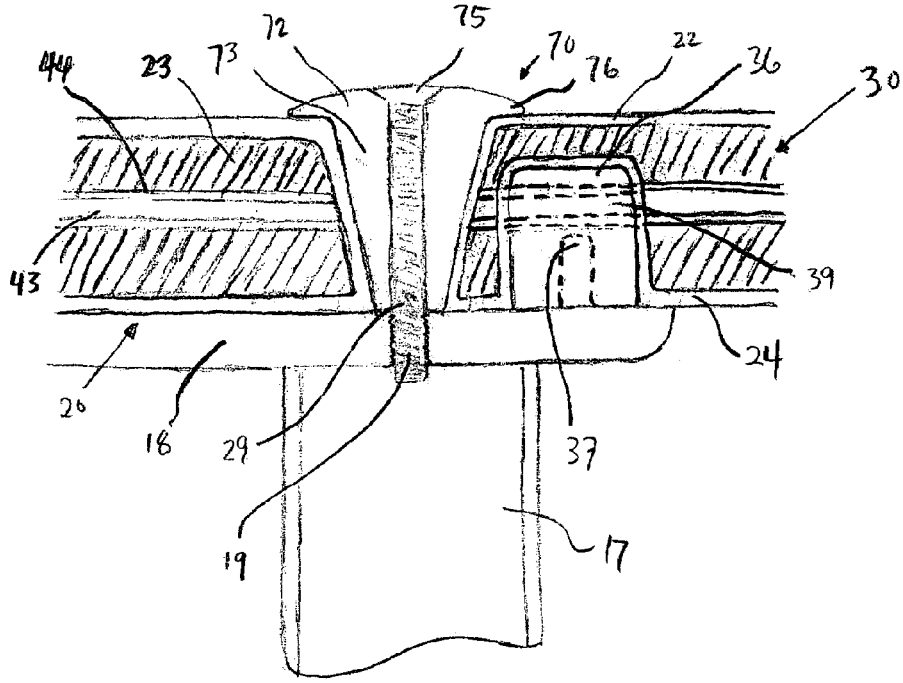
FIG. 4 is an enlarged view of a portion of the canopy shown in FIG. 2.

FIG. 4 is an enlarged view of the portion A of the canopy 20 shown in FIG. 2. The embodiment of the molded canopy 20 shown in FIG. 4 includes an outer skin 21 having top 22 and bottom 24 layers, and a foam support layer 23 between the layers 22 and 24. The foam support layer 23 may substantially fill the space between the layers 22 and 24 of the outer skin 21 or may only fill a portion of the space between the layers 22 and 24. A support 36 at least partially surrounded by the foam support layer 23 may be a molded-in insert that is molded through or within the outer skin to suspend equipment 31 including one or more of a wire 43 and a wire chase 44 within the foam support layer 23, i.e., the wire 43 can be suspended within the layer 23 without the wire chase 44. The wire 43 can be of the type used for a radio speaker or light system, for example. Each support 36 includes a passage 39 transverse the opening 37. This passage 39 can be used to suspend the equipment 31 within the foam support layer 23.

The outer skin of the embodiment of the canopy 20 shown in FIG. 4 also includes an opening 29 for a blind fastener system 70. The blind fastener system 70 retains the canopy 20 to a mounting pad 18 attached to an elevation member 17 providing the frame 16 shown in FIG. 1. The system 70 is not visible from below the canopy 20. The system 70 includes an insert 72, a fastener 75 and the mounting pad 18. The insert 72 may include one or more of a lip 76 at its top, a wedge or cone-shaped portion 73 and a cylindrical opening for inserting a fastener. The mounting pad 18 includes an opening 19 for inserting the fastener 75.

Figure 5:
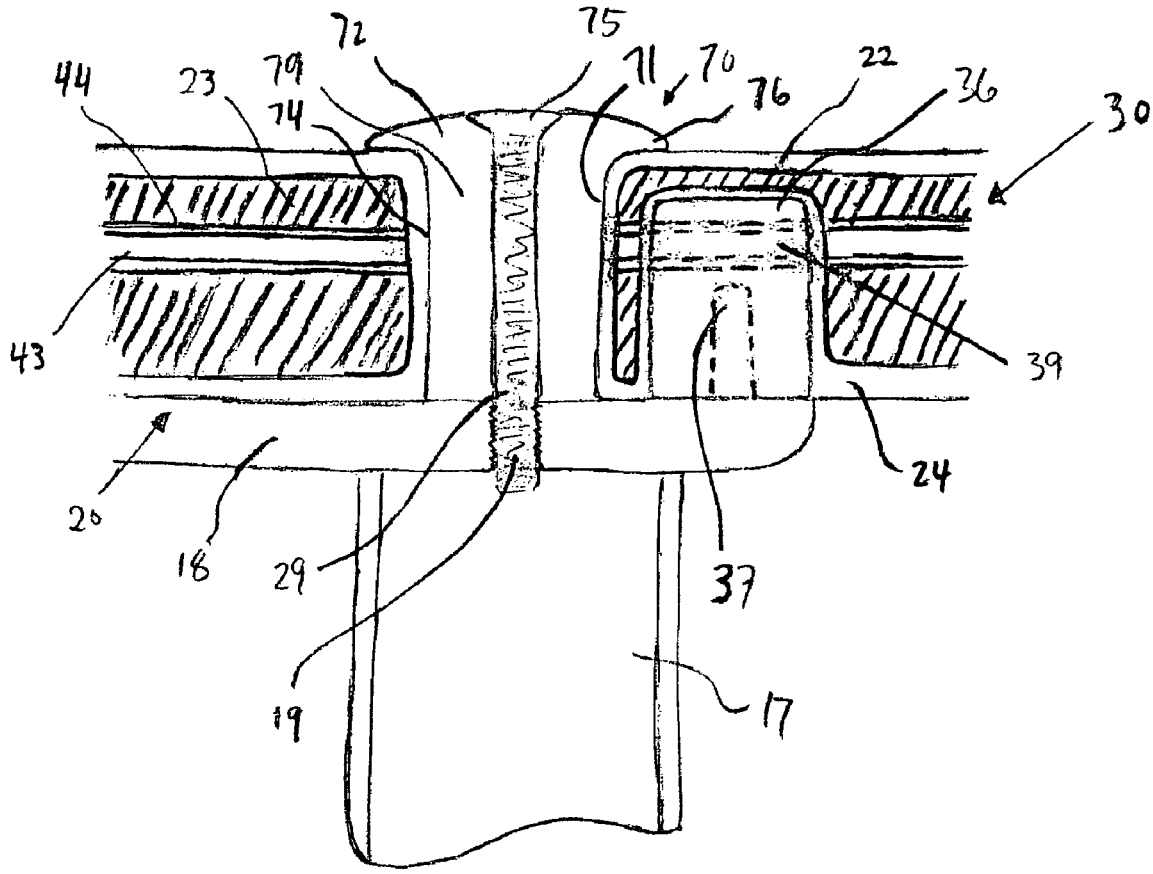
FIG. 5 is an alternative embodiment of the portion of the canopy shown in FIG. 4.

FIG. 5 shows an embodiment of the blind fastener system 70 including a portion 79 having substantially parallel walls 71 and 74.

Figure 6:
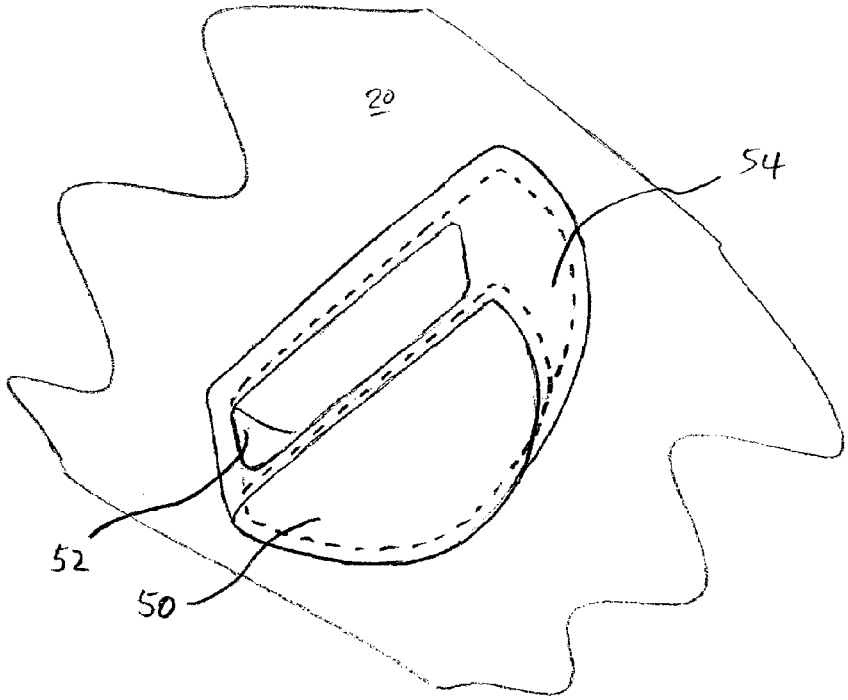
FIG. 6 is a bottom perspective view of an integrally formed electronics box of a molded canopy.

FIG. 6 is a bottom perspective view of the canopy 20 showing an embodiment of an integrally molded electronics box 50 having inner 52 and outer 54 walls. The bottom layer of the outer skin may form the inner wall 52 of the box 50 with an additional outer wall 54 below. A foam layer (shown in FIG. 2) can be employed between the walls 52 and 54 for support. Neither a separate insert to form the inner wall 52 nor fasteners for attaching any such insert are required to form the box 50.

Certain modifications and improvements will occur to those skilled in the art upon a reading of the foregoing description. By way of example, the canopy 20 can be configured to provide for accessories such as rod holders. All such modifications and improvements have not been included herein for the sake of conciseness and readability but are properly within the scope of the appended claims.

We claim:

1. An integrally formed, internally supported, molded canopy for a vehicle comprising an internal electrical system; an outer skin having a top layer and a bottom layer; a foam support layer between the top and bottom layers of the outer skin wherein the foam support layer substantially fills the space between the top and bottom layers of the outer skin; and a plurality of supports molded through or within the outer skin and at least partially surrounded by the foam support layer, the supports for suspending equipment within the foam support layer.

2. The canopy according to claim 1 wherein the plurality of supports comprise a molded-in insert.

3. The canopy according to claim 2 further comprising a passage in each support transverse the opening in the support.

4. The canopy according to claim 1 wherein the equipment comprises electrical equipment.

5. The canopy according to claim 4 wherein the electrical equipment comprises a wire chase.

6. The canopy according to claim 4 wherein the equipment comprises a wire.

7. The canopy according to claim 1 further comprising an integrally formed, double walled electronics box.

8. The canopy according to claim 1 further comprising a blind fastener system for attaching the canopy to a frame comprising a mounting pad.

9. An apparatus comprising:

(a) a vehicle;

(b) a console attached to the vehicle;

(c) an integrally formed, internally supported, molded canopy including an internal electrical system therein; an outer skin having a top layer and a bottom layer; a foam support layer between the top and bottom layers of the outer skin wherein the foam support layer substantially fills the space between the top and bottom layers of the outer skin; and a plurality of supports molded through or within the outer skin and at least partially surrounded by the foam support layer, the supports for suspending equipment within the foam support layer and (d) a frame for supporting the canopy attached to the vehicle.

10. The apparatus according to claim 9 wherein the frame supports the canopy above the console.

11. The apparatus according to claim 10 wherein the frame comprises an elevation member and a mounting pad.

12. The apparatus according to claim 9 wherein the vehicle comprises a marine vessel.

13. The apparatus according to claim 9 wherein the vehicle comprises a motor.

14. The apparatus according to claim 13 wherein the motor comprises a propeller.

15. The apparatus according to claim 9 wherein the plurality of supports comprise a molded-in insert.

16. The apparatus according to claim 15 further comprising a passage in each support transverse the opening in the support.

17. The apparatus according to claim 9 wherein the equipment comprises electrical equipment.

18. The apparatus according to claim 17 wherein the electrical equipment comprises a wire chase.

19. The apparatus according to claim 17 wherein the equipment comprises a wire.

20. The apparatus according to claim 9 wherein the canopy further comprises an integrally formed, double walled electronics box.

21. The apparatus according to claim 9 further comprising a blind fastener system for attaching the canopy to a frame comprising a mounting pad.

* * * * *